US010294083B2

(12) United States Patent
Lin et al.

(10) Patent No.: US 10,294,083 B2
(45) Date of Patent: May 21, 2019

(54) TRANSPORTATION PLATFORM FOR UNDERWATER TOWING DEVICE

(71) Applicant: DALIAN UNIVERSITY OF TECHNOLOGY, Dalian (CN)

(72) Inventors: Yan Lin, Dalian (CN); Xiaoning Jiang, Dalian (CN); Yanyun Yu, Dalian (CN)

(73) Assignee: DALIAN UNIVERSITY OF TECHNOLOGY, Dalian (CN)

( * ) Notice: Subject to any disclaimer, the term of this patent is extended or adjusted under 35 U.S.C. 154(b) by 0 days.

(21) Appl. No.: 15/953,488

(22) Filed: Apr. 15, 2018

(65) Prior Publication Data

US 2018/0229975 A1 Aug. 16, 2018

Related U.S. Application Data

(63) Continuation-in-part of application No. PCT/CN2017/078083, filed on Mar. 24, 2017.

(30) Foreign Application Priority Data

Apr. 6, 2016 (CN) ..... 2016 1 0208459

(51) Int. Cl.

| | |
|---|---|
| ***B66C 13/02*** | (2006.01) |
| ***B66C 13/08*** | (2006.01) |
| ***B63C 15/00*** | (2006.01) |
| ***B63B 21/66*** | (2006.01) |
| ***B63B 27/16*** | (2006.01) |

(52) U.S. Cl.

CPC ..... *B66C 13/02* (2013.01); *B63B 21/66* (2013.01); *B63B 27/16* (2013.01); *B63C 15/00* (2013.01); *B66C 13/08* (2013.01); *B63B 2027/165* (2013.01)

(58) Field of Classification Search

CPC ..... B66C 13/02; B66C 13/08; B63C 15/00; B63C 11/52; B63B 27/36

USPC ..... 414/803

See application file for complete search history.

(56) References Cited

U.S. PATENT DOCUMENTS

| | | | | |
|---|---|---|---|---|
| 3,536,023 | A * | 10/1970 | Bascom | B63B 27/36 114/259 |
| 9,611,012 | B2 * | 4/2017 | Lin | B63B 21/10 |
| 2002/0152946 | A1 * | 10/2002 | Delahousse | B63B 27/36 114/312 |

(Continued)

*Primary Examiner* — Lynn E Schwenning

(74) *Attorney, Agent, or Firm* — Matthias Scholl P.C.; Matthias Scholl

(57) ABSTRACT

A transportation platform for an underwater towing device, including: a main frame; a support frame; a movable base; operation decks; ladder stands; and main lifting lugs. The main frame includes upright posts, basal tubes, longitudinal tubes, transverse tubes, and diagonal tubes. The support frame includes cushion blocks, transverse beams, stand columns, carrier bars, and stiffeners. The ladder stands include stand pipes and a plurality of deformed bar. The main lifting lugs are disposed on the upright posts of the main frame. The support frame is in the form of a door frame and disposed in the lower part of the main frame. The carrier bars cross over the basal tubes. The stiffeners are disposed between the upright posts of the main frame and the transverse beams. The cushion blocks are disposed on the carrier bars. The movable base is disposed between the carrier bars of the support frame.

7 Claims, 9 Drawing Sheets

(56) References Cited

U.S. PATENT DOCUMENTS

2006/0180069 A1* 8/2006 Stolzer ..... B63C 3/06
114/44
2016/0325805 A1* 11/2016 Lin ..... B63B 21/10

* cited by examiner

TRANSPORTATION PLATFORM FOR UNDERWATER TOWING DEVICE

CROSS-REFERENCE TO RELATED APPLICATIONS

This application is a continuation-in-part of International Patent Application No. PCT/CN2017/078083 with an international filing date of Mar. 24, 2017, designating the United States, now pending, and further claims foreign priority benefits to Chinese Patent Application No. 201610208459.X filed Apr. 6, 2016. The contents of all of the aforementioned applications, including any intervening amendments thereto, are incorporated herein by reference.

BACKGROUND OF THE INVENTION

Field of the Invention

This disclosure relates to underwater towing devices, and more particularly to a transportation platform for an underwater towing device.

Description of the Related Art

Typically, the underwater towing devices are bulky and difficult to transfer from the land to an operation region. The towing devices are dismantled into pieces for transportation and then are reassembled in the operation region, which greatly reduces the efficiency of marine survey. Thus, it is urgent to develop a transportation platform adapting to transfer an underwater towing device in its entirety.

SUMMARY OF THE INVENTION

In view of the above-described problems, it is one objective of the invention to provide a transportation platform for an underwater towing device that is firm, inexpensive, and easy to assemble. The transportation platform is particularly suitable for the installation, storage, transportation, and protection of the underwater towing devices.

To achieve the above objective, in accordance with one embodiment of the invention, there is provided a transportation platform for an underwater towing device, the transportation platform comprising: a main frame; a support frame; a movable base; operation decks; ladder stands; and main lifting lugs.

The main frame comprises upright posts, basal tubes, longitudinal tubes, transverse tubes, and diagonal tubes. The support frame comprises cushion blocks, transverse beams, stand columns, carrier bars, and stiffeners. The ladder stands comprise stand pipes and a plurality of deformed bar.

The main lifting lugs are disposed on the upright posts of the main frame; the support frame is in the form of a door frame and disposed in a lower part of the main frame; the carrier bars cross over the basal tubes; the stiffeners are disposed between the upright posts of the main frame and the transverse beams; the cushion blocks are disposed on the carrier bars; one end of the stand columns is connected to the carrier bars, and the other end thereof is connected to the transverse beams; the movable base is disposed between the carrier bars of the support frame, and is connected to the support frame via chains; the operation decks are in the form of a stiffened plate, and are disposed on the upright posts of the main frame; the longitudinal tubes are located at an outer side of the operation decks; and handrails are disposed on the upright posts and above the operation decks; and the ladder stands are disposed at two side of the main frame.

In a class of this embodiment, the movable base comprises arc pads, concave clampers, first lifting lugs, horizontal tubes, a plurality of longitudinal bars, the horizontal tubes, and square legs; the plurality of longitudinal bars is disposed between and vertical to the horizontal tubes; the arc pads and the concave clampers are disposed on the horizontal tubes, and the arc pads are clamped in the concave clampers; the first lifting lugs are disposed at two ends of the horizontal tubes; and the square legs are disposed at four bottom corners of the movable base.

In a class of this embodiment, the house further comprises a movable brace rod which is disposed at an upper opening of the main frame; the inner sides of the upright posts are provided with concave holders, and the movable brace rod is supported by the concave holders.

In a class of this embodiment, the stiffeners are made of angle steel, the transverse beams and the stand columns are made of channel steel; inner sides of the stand columns are provided with second lifting lugs; and the second lifting lugs are connected to the first lifting lugs via the chains.

In a class of this embodiment, the longitudinal tubes on an upper part of the main frame are provided with fourth lifting lugs which are symmetrically distributed.

In a class of this embodiment, the upright posts, the movable brace rod, the carrier bars, the stand pipes, the square legs, the plurality of longitudinal bars, and the horizontal tubes employ square tubes.

The disclosure also provides a method for using the transportation platform for an underwater towing device, the method comprising:

1) removing a movable brace rod disposed at an upper opening of the main frame;
2) employing a truck crane to install a main body of a towing device in an upper part of the transportation platform, employing a fork lift to install a lower part of the towing device on the movable base of the transportation platform, and lifting up the movable base to fix the main body on the lower part of the towing device;
3) mounting the movable brace rod in concave holders of the upright posts;
4) connecting a top of the towing device and fourth lifting lugs of the longitudinal tubes via cables;
5) hoisting and transferring the transportation platform and the towing device using the truck crane to a tug boat; and
6) transporting the transportation platform and the towing device to a destination, and unloading the towing device out of the transportation platform.

Advantages of the transportation platform for an underwater towing device are summarized as follows. The transportation platform comprises a main frame; a support frame; a movable base; operation decks; ladder stands; and main lifting lugs. The main frame of the transportation platform is made of square tubes, and is easy to assemble, thus reducing the production costs. The support frame and the movable base are disposed at the bottom of the transportation platform, which forms a multifunctional platform for installation, storage, transportation and maintenance of underwater towing device. Meanwhile, considering the convenience and safety of the operation, the ladder stand and multi-layer operation decks are designed to ensure the safety of the staff. The movable base provides convenience for the installation of the towing body. The arrangement of the diagonal tubes and the movable brace rod improves the strength and stability of the transportation platform. The arrangement of the lifting lugs ensures the operation safety in case of severe environment. The transportation platform solves the hoisting problem of large-sized and complex towing devices, and provides a safe, reliable, efficient tool for hoisting the underwater towing devices.

BRIEF DESCRIPTION OF THE DRAWINGS

The invention is described hereinbelow with reference to the accompanying drawings, in which.

Figure 1:
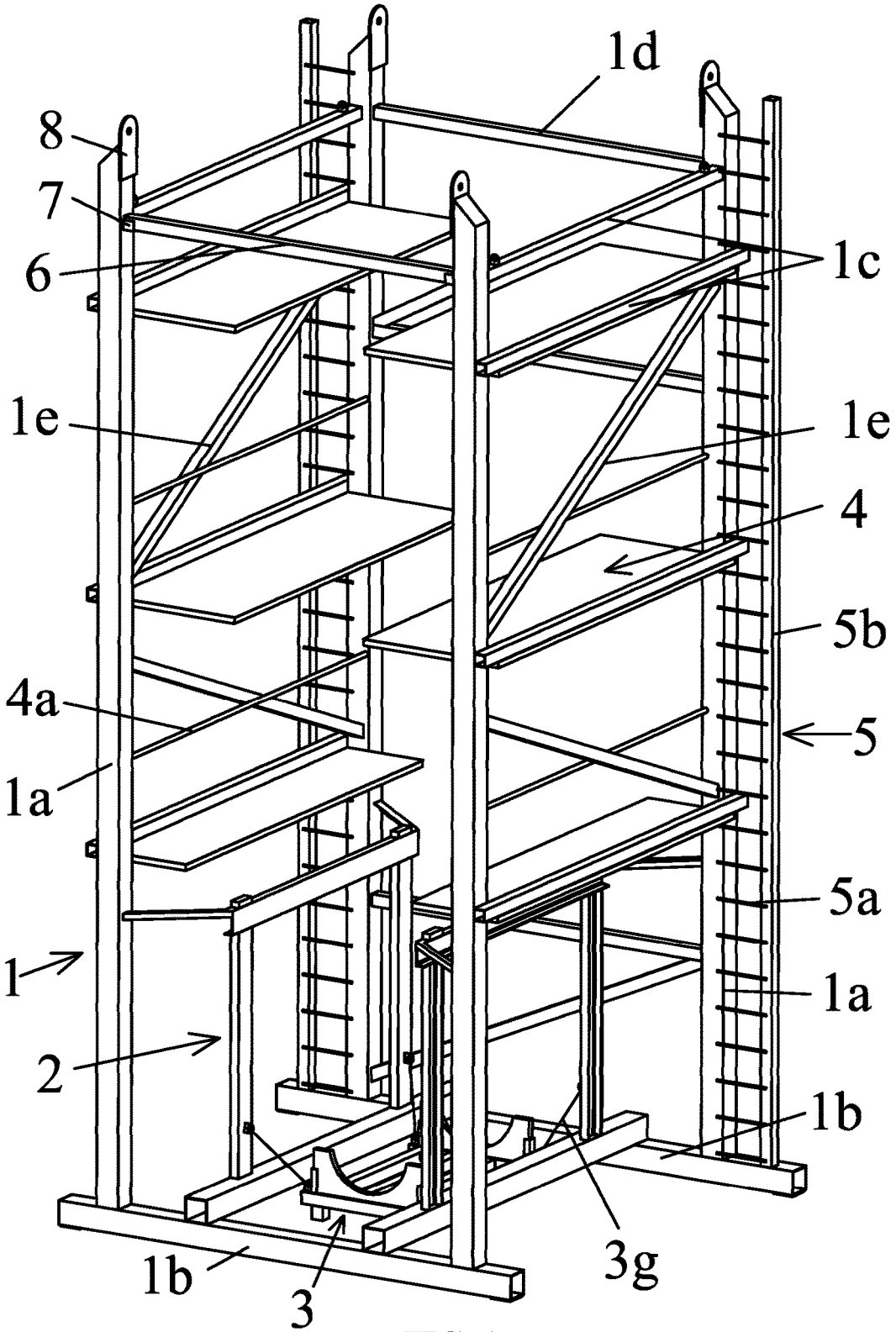
FIG. 1 is a schematic diagram of a transportation platform for an underwater towing device in accordance with one embodiment of the disclosure.

In the drawings, the following reference numbers are used: 1. main frame; 1*a*. upright post; 1*b*. basal tube; 1*c*. longitudinal tube; 1*d*. transverse tube; 1*e*. diagonal tube; 1*f*. fourth lifting lug; 2. support frame; 2*a*. cushion block; 2*b*. transverse beam; 2*c*. stand column; 2*d*. carrier bar; 2*e*. stiffener; 2*f*. second lifting lug; 3. movable base; 3*a*. arc pad; 3*b*. concave clamper; 3*c*. first lifting lug; 3*d*. horizontal tube; 4. operation deck; 4*a*. handrail; 5. ladder stand; 5*a*. deformed bar; 5*b*. stand pipe; 6. movable brace rod; 7. concave holder; 8. lifting lug; 9. towing device; 9*a*. main body of the towing device; 9*b*. lower part of the towing device; 9*c*. top of the towing device; 10. cable; 11. truck crane; 12. tug boat.

DETAILED DESCRIPTION OF THE EMBODIMENT

For further illustrating the invention, experiments detailing a transportation platform for an underwater towing device are described below. It should be noted that the following examples are intended to describe and not to limit the invention.

Figure 2:
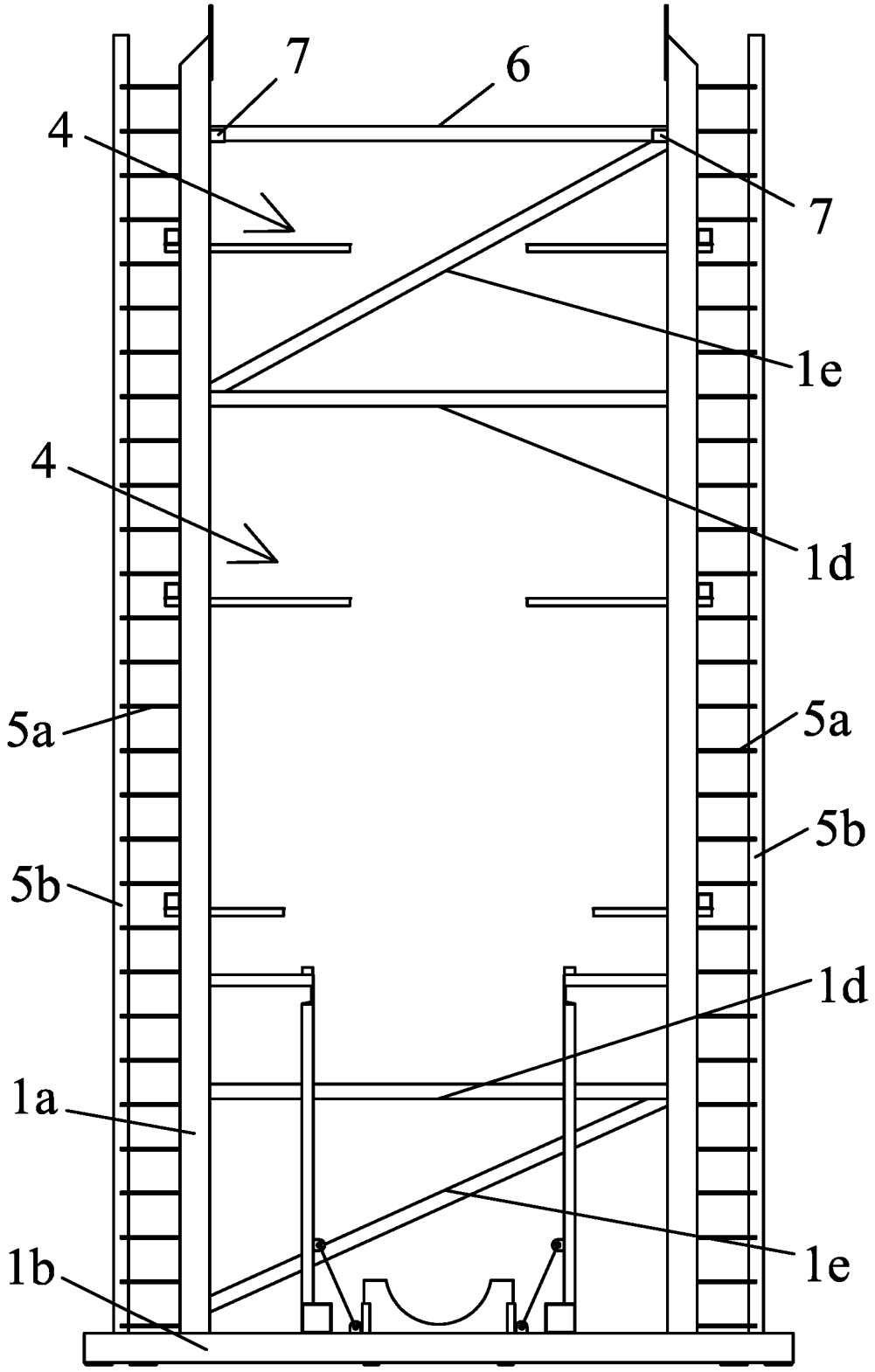
FIG. 2 is a front view of a transportation platform for an underwater towing device in accordance with one embodiment of the disclosure.
Figure 3:
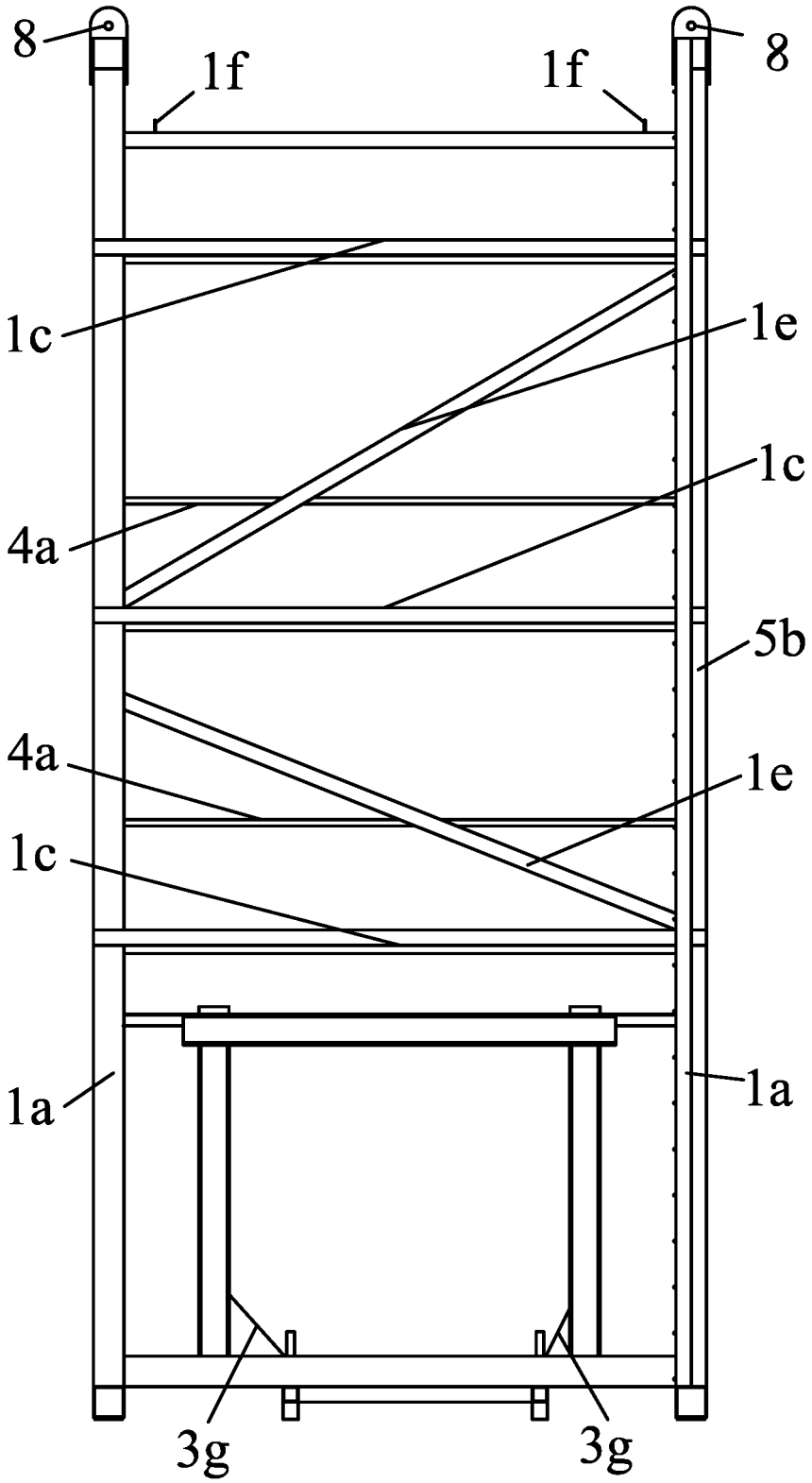
FIG. 3 is a side view of a transportation platform for an underwater towing device in accordance with one embodiment of the disclosure.

FIGS. 1-3 are schematic diagrams of a transportation platform for an underwater towing device of the example. The underwater towing device comprises a main frame 1, a support frame 2, a movable base 3, operation decks 4, and ladder stands 5. The main frame 1 is of box type, and comprises upright posts 1*a*, basal tubes 1*b*, longitudinal tubes 1*c*, transverse tubes 1*d*, and diagonal tubes 1*e*. The top of the upright posts 1*a* of the main frame is equipped with main lifting lugs 8 for hoisting the transportation platform. The operation decks 4 are in the form of a stiffened plate, and are disposed on the upright posts 1*a* of the main frame; the longitudinal tubes 1*c* are located at an outer side of the operation decks 4 to ensure the strength of the operation decks 4. The handrails 4*a* are disposed on the upright posts and above the operation decks 4, facilitating the operation of the staff. The ladder stands 5 are disposed at two side of the main frame 1, and comprise stand pipes 5*b* and a plurality of deformed bar 5*a*. Thus, the staff can reach each layer of the operation decks via the ladder stands 5. The transportation platform further comprises a movable brace rod 6 which is disposed at an upper opening of the main frame; the inner sides of the upright posts 1*a* are provided with concave holders 7, and the movable brace rod 6 is supported by the concave holders 7. The arrangement of the movable brace rod 6 improves the strength of the transportation platform, and meanwhile does not affect the installation of the towing device 9. The longitudinal tubes 1*c* on an upper part of the main frame are provided with fourth lifting lugs 1*f* which are symmetrically distributed for binding the towing device 9, ensuring the stability and safety of the towing device 9 upon hoisting and transportation. The upright posts 1*a*, the movable brace rod 6, the carrier bars 2*d*, the stand pipes 5*b*, the square legs 3*f*, the plurality of longitudinal bars 3*e*, and the horizontal tubes 3*d* employ square tubes, which are inexpensive.

Figure 4:
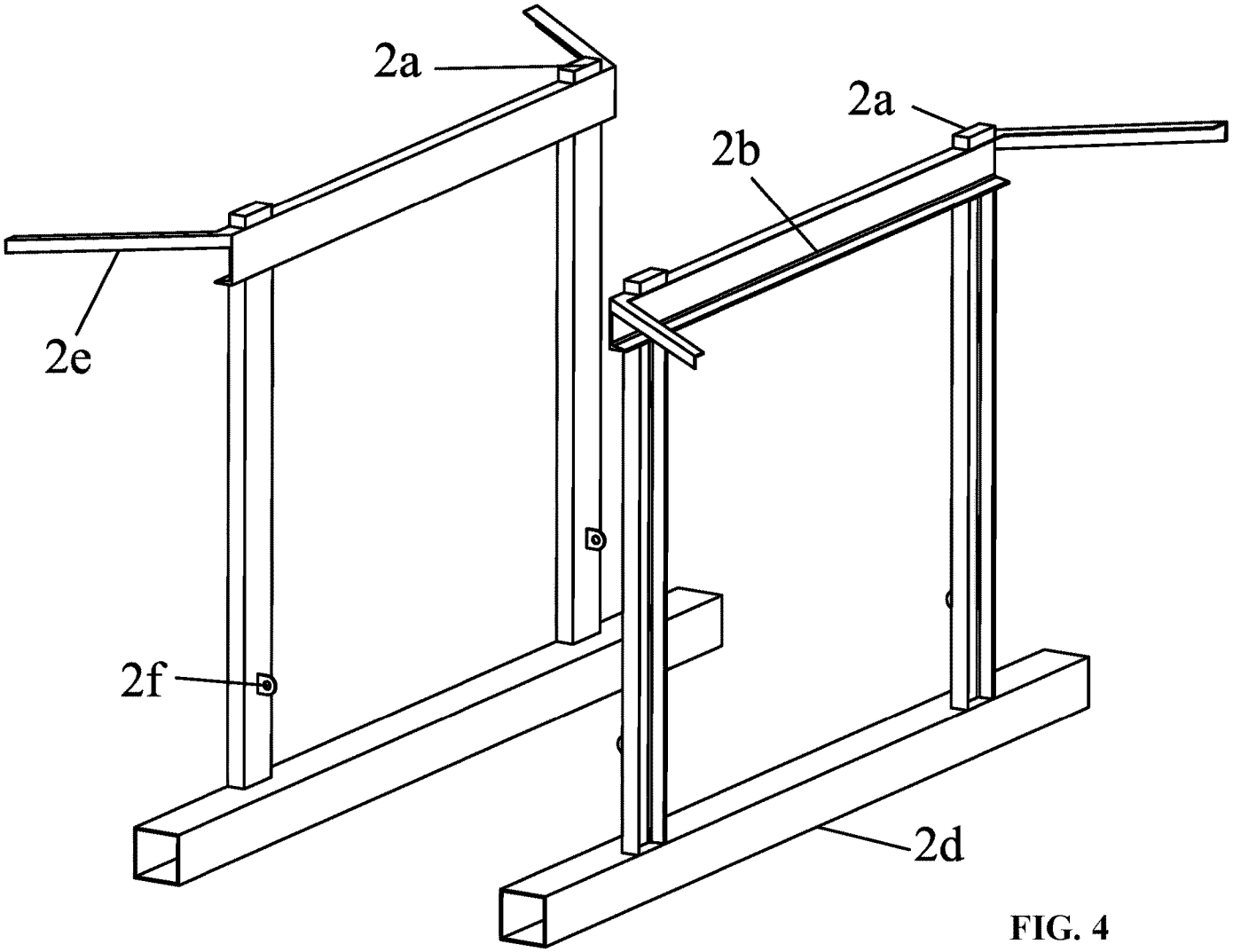
FIG. 4 is a schematic diagram of a support frame of a transportation platform for an underwater towing device in accordance with one embodiment of the disclosure.
Figure 5:
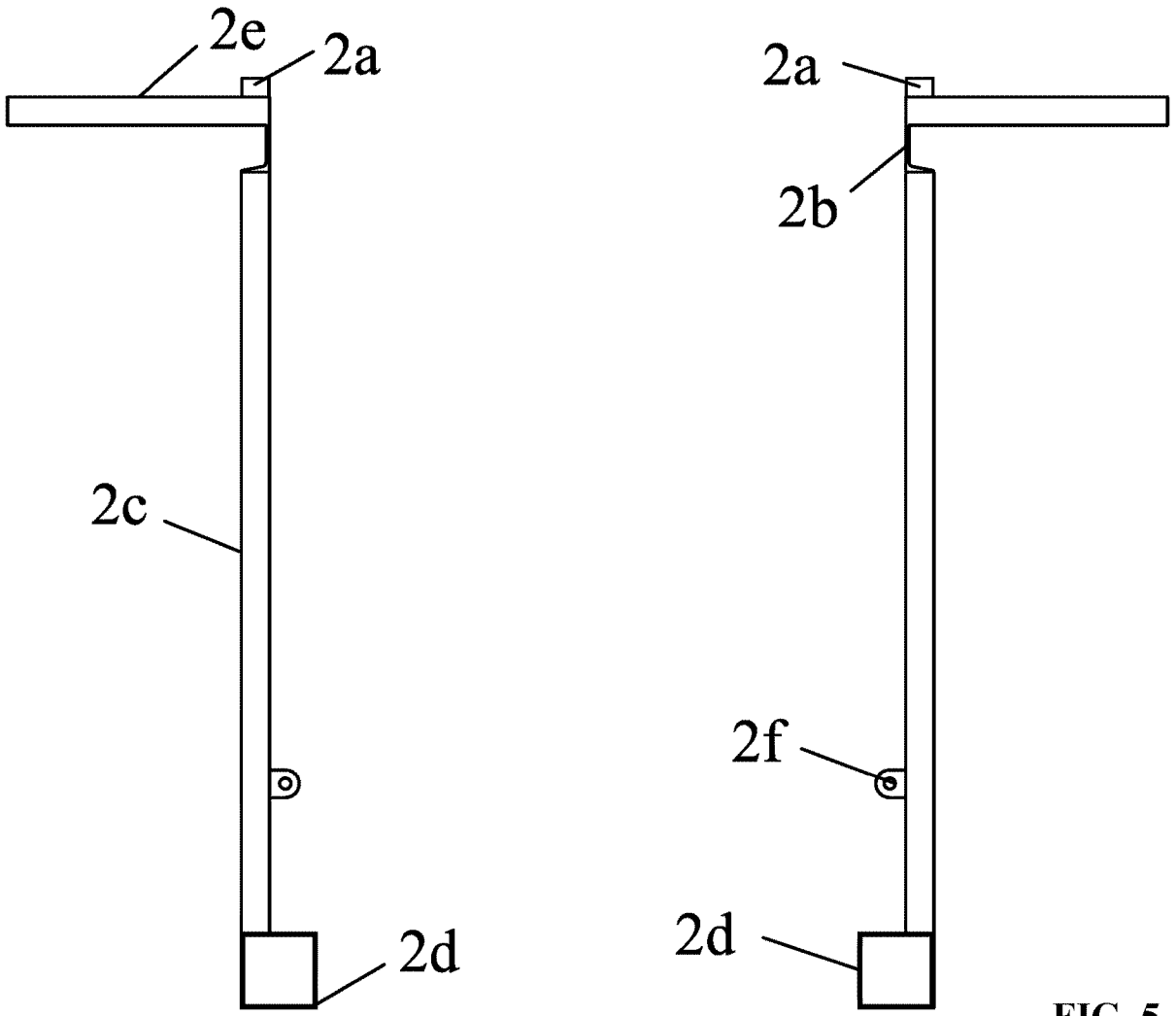
FIG. 5 is a front view of a support frame of a transportation platform for an underwater towing device in accordance with one embodiment of the disclosure.

FIGS. 4-5 are schematic diagrams of a support frame of the transportation platform for an underwater towing device. The support frame 2 is in the form of a door frame and disposed in a lower part of the main frame 1. The support frame 2 comprises cushion blocks 2*a*, transverse beams 2*b*, stand columns 2*c*, carrier bars 2*d*, and stiffeners 2*e*. The carrier bars 2*d* cross over the basal tubes 1*b*; the stiffeners 2*e* are disposed between the upright posts 1*a* of the main frame and the transverse beams 2*b*. The stiffeners 2*e* are made of angle steel, the transverse beams 2*b* and the stand columns 2*c* are made of channel steel; inner sides of the stand columns 2*c* are provided with second lifting lugs 2*f*; and the second lifting lugs 2*f* are connected to the first lifting lugs 3*c* via the chains 3*g*.

Figure 6:
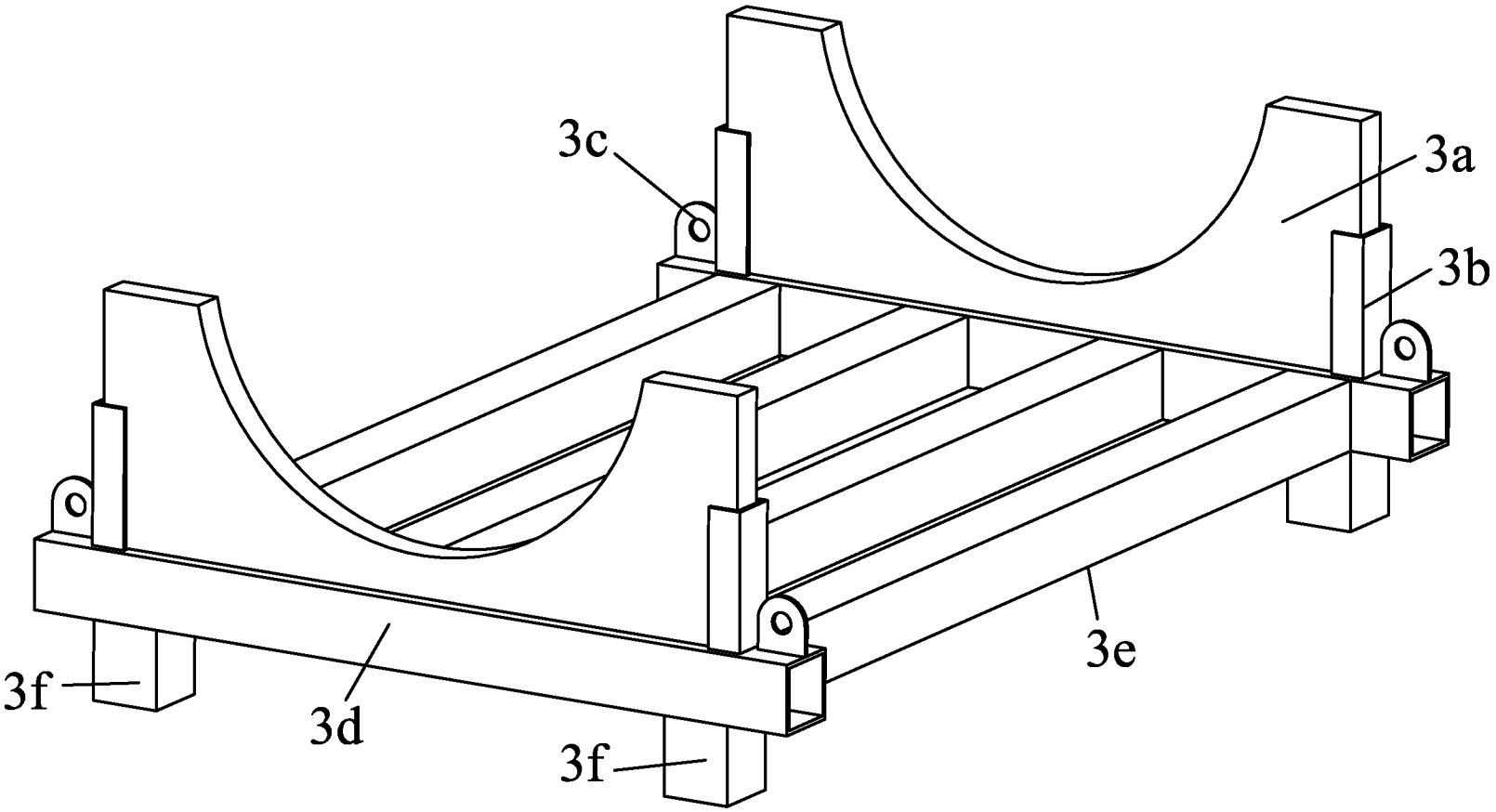
FIG. 6 is a schematic diagram of a movable base of a transportation platform for an underwater towing device in accordance with one embodiment of the disclosure.
Figure 7:
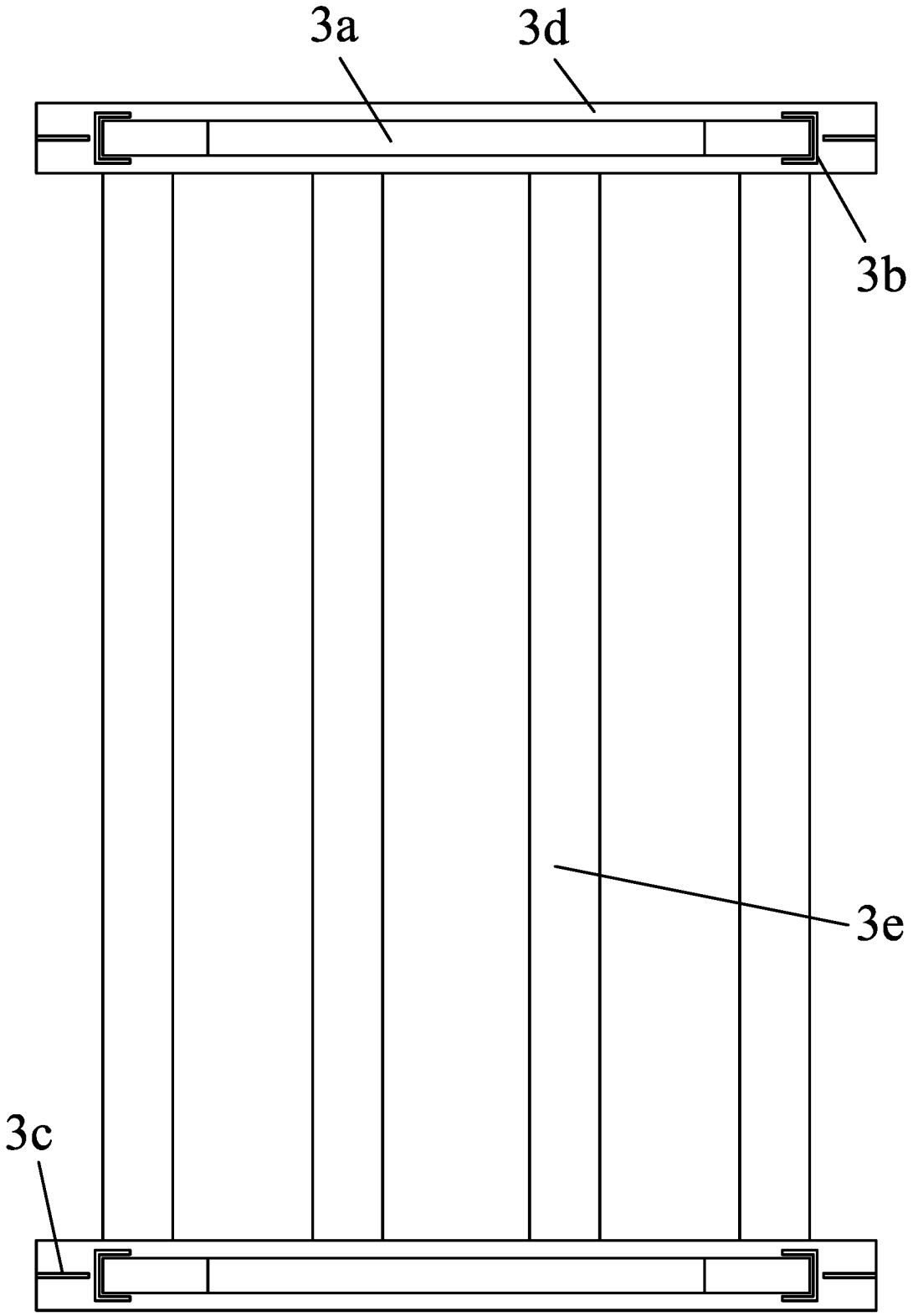
FIG. 7 is a top view of a movable base of a transportation platform for an underwater towing device in accordance with one embodiment of the disclosure.

FIGS. 6-7 are schematic diagrams of a movable base of the transportation platform for an underwater towing device. The movable base 3 comprises arc pads 3*a*, concave clampers 3*b*, first lifting lugs 3*c*, horizontal tubes 3*d*, a plurality of longitudinal bars 3*e*, the horizontal tubes 3*d*, and square legs 3*f*; the plurality of longitudinal bars 3*e* is disposed between and vertical to the horizontal tubes 3*d*; the arc pads 3*a* and the concave clampers 3*b* are disposed on the horizontal tubes 3*d*, and the arc pads 3*a* are clamped in the concave clampers 3*b*; the first lifting lugs 3*c* are disposed at two ends of the horizontal tubes 3*d*; and the square legs 3*f* are disposed at four bottom corners of the movable base 3. The first lifting lugs 3*c* are connected to the second lifting lugs 2*f* via the chains 3*g*. The movable base 3 can move in a small range, thus facilitating the installation and operation of the lower part 9*b* of the towing device 9.

Figure 8:
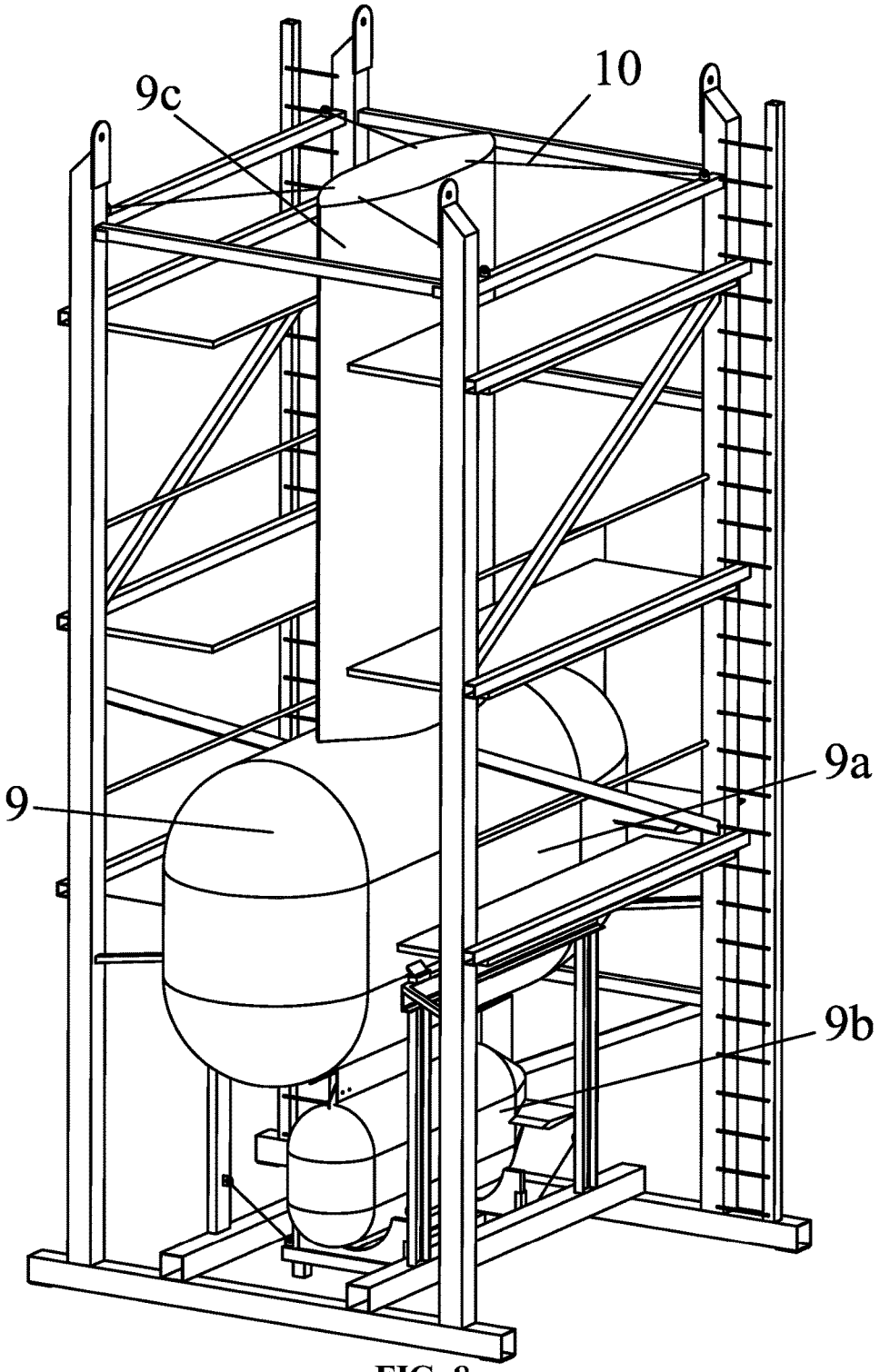
FIG. 8 is an operation diagram of a transportation platform for an underwater towing device in accordance with one embodiment of the disclosure.
Figure 9:
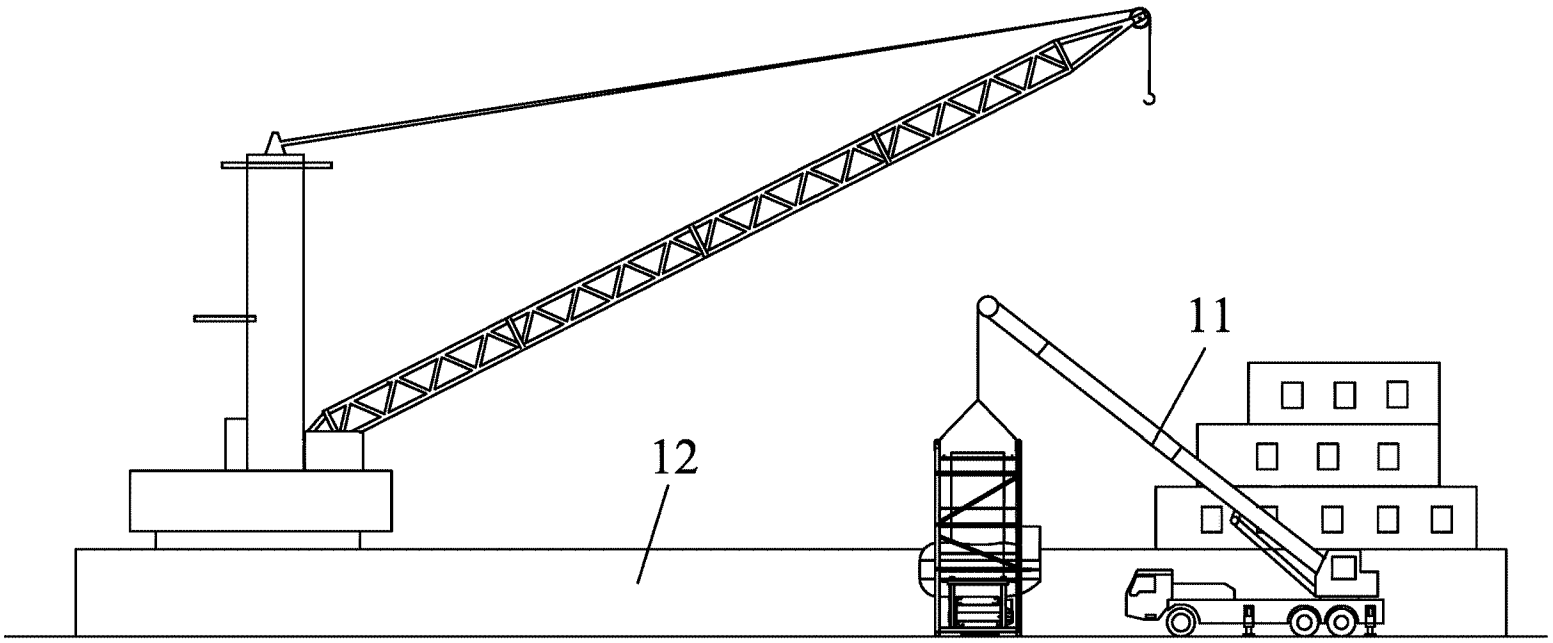
FIG. 9 illustrates a hoisting process of a transportation platform for an underwater towing device in accordance with one embodiment of the disclosure.

FIGS. 8-9 are installation and hoisting diagrams of the transportation platform for an underwater towing device. The underwater towing device 9 is installed in the transportation platform. The entire weight of the towing device 9 is supported by the cushion block 2*a*. The top 9*c* of the towing device 9 is connected to the fourth lifting lugs 1*f* of the longitudinal tubes 1*c* via cables 10, thus ensuring the harmony of the towing device and the transportation platform, preventing the instability of the towing device in the process of hoisting. When the towing device is bound and fixed stably, a truck crane 11 hoists the house and the towing device via the main lifting lugs 8 to a tub boat equipped with a crane, and then the tub boat transports the transportation platform and the towing device 9 to a destination.

A method for using a transportation platform for an underwater towing device comprises the following steps: 1) removing a movable brace rod 6 disposed at an upper opening of the main frame; 2) employing a truck crane 11 to install a main body 9*a* of a towing device 9 in an upper part of the transportation platform, employing a fork lift to install a lower part 9*b* of the towing device 9 on the movable base 3 of the transportation platform, and lifting up the movable base 3 to fix the main body 9*a* on the lower part 9*b* of the towing device 9; 3) mounting the movable brace rod 6 in concave holders 7 of the upright posts 1*a;* 4) connecting a top 9*c* of the towing device 9 and fourth lifting lugs of the longitudinal tubes 1*c* via cables 10; 5) hoisting and transferring the transportation platform and the towing device 9 using the truck crane 11 to a tug boat 12; and 6) transporting the transportation platform and the towing device 9 to a destination, unloading the towing device 9 out of the transportation platform, and submerging the towing device 9 in water for operation.

Unless otherwise indicated, the numerical ranges involved in the invention include the end values. While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

The invention claimed is:

1. A transportation platform for an underwater towing device, the transportation platform comprising:

a main frame, the main frame comprising upright posts, basal tubes, longitudinal tubes, transverse tubes, and diagonal tubes;

a support frame, the support frame comprising cushion blocks, transverse beams, stand columns, carrier bars, and stiffeners;

a movable base;

operation decks;

ladder stands, the ladder stands comprising stand pipes and a plurality of bars; and main lifting lugs;

wherein:

the main lifting lugs are disposed on the upright posts of the main frame;

the support frame is disposed in a lower part of the main frame;

the carrier bars cross over the basal tubes; the stiffeners are disposed between the upright posts of the main frame and the transverse beams;

the cushion blocks are disposed on the carrier bars;

one end of the stand columns is connected to the carrier bars, and the other end thereof is connected to the transverse beams;

the movable base is disposed between the carrier bars of the support frame, and is connected to the support frame via chains;

the operation decks are in the form of a stiffened plate, and are disposed on the upright posts of the main frame; the longitudinal tubes are located at an outer side of the operation decks; and handrails are disposed on the upright posts and above the operation decks; and the ladder stands are disposed at two sides of the main frame.

2. The platform of claim 1, wherein the movable base comprises arc pads, concave clampers, first lifting lugs, horizontal tubes, a plurality of longitudinal bars, and square legs; the plurality of longitudinal bars is disposed between and perpendicular to the horizontal tubes; the arc pads and the concave clampers are disposed on the horizontal tubes, and the arc pads are clamped in the concave clampers; the first lifting lugs are disposed at two ends of the horizontal tubes; and the square legs are disposed at four bottom corners of the movable base.

3. The platform of claim 2, further comprising a movable brace rod which is disposed at an upper opening of the main frame, wherein inner sides of the upright posts are provided with concave holders, and the movable brace rod is supported by the concave holders.

4. The platform of claim 3, wherein the upright posts, the movable brace rod, the carrier bars, the stand pipes, the square legs, the plurality of longitudinal bars, and the horizontal tubes employ square tubes.

5. The platform of claim 2, wherein the stiffeners are made of angle steel, the transverse beams and the stand columns are made of channel steel; inner sides of the stand columns are provided with second lifting lugs; and the second lifting lugs are connected to the first lifting lugs via the chains.

6. The platform of claim 1, wherein the longitudinal tubes on an upper part of the main frame are provided with fourth lifting lugs which are symmetrically distributed.

7. A method for using the transportation platform for an underwater towing device of claim 1, the method comprising:

1) removing a movable brace rod disposed at an upper opening of the main frame;

2) employing a truck crane to install a main body of a towing device in an upper part of the transportation platform, installing a lower part of the towing device on the movable base of the transportation platform, and moving the movable base in its movable range that is allowed by the chains connecting the movable base to the support frame to fix the main body on the lower part of the towing device;

3) mounting the movable brace rod in concave holders of the upright posts;

4) connecting a top of the towing device and fourth lifting lugs of the longitudinal tubes using cables;

5) hoisting and transferring the transportation platform and the towing device using the truck crane to a tug boat; and 6) transporting the transportation platform and the towing device to a destination, and unloading the towing device out of the transportation platform.

* * * * *